US008590156B2

(12) United States Patent
Murray

(10) Patent No.: US 8,590,156 B2
(45) Date of Patent: Nov. 26, 2013

(54) METHOD FOR ASSEMBLING AN INKJET PRINTHEAD

(75) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 910 days.

(21) Appl. No.: 12/750,747

(22) Filed: Mar. 31, 2010

(65) Prior Publication Data

US 2011/0239461 A1 Oct. 6, 2011

(51) Int. Cl.
*B21D 53/00* (2006.01)

(52) U.S. Cl.
USPC ..... 29/890.1; 29/25.35; 29/592.1; 347/68; 347/70; 347/71

(58) Field of Classification Search
USPC ..... 29/25.35, 592.1, 890.1; 347/40, 44, 65, 347/66, 85, 86
See application file for complete search history.

(56) References Cited

U.S. PATENT DOCUMENTS 5,652,610 A 7/1997 Kawai et al.
8,147,033 B2 * 4/2012 Murray ..... 347/40
8,235,514 B2 * 8/2012 Murray ..... 347/87
8,256,876 B2 * 9/2012 Murray ..... 347/49
8,277,034 B2 * 10/2012 Murray et al. ..... 347/92
8,313,181 B2 * 11/2012 Murray ..... 347/87
8,322,834 B2 * 12/2012 Murray ..... 347/85
8,376,487 B2 * 2/2013 Murray ..... 347/9
8,469,501 B2 * 6/2013 Murray ..... 347/86
8,469,502 B2 * 6/2013 Murray ..... 347/87

* cited by examiner

*Primary Examiner* — Paul D Kim
(74) *Attorney, Agent, or Firm* — Peyton C. Watkins

(57) ABSTRACT

A method of assembling an inkjet printhead, the method comprising the steps of providing a die mount substrate including a die mount surface, an ink receiving surface, a first end wall having a latchable projection and a second end wall having an extension; providing a printhead die including at least one nozzle array and a plurality of bond pads; attaching the printhead die to the die mount surface of the die mount substrate; providing a wiring member; adhering a portion of the wiring member to the die mount surface of the die mount substrate; electrically interconnecting the wiring member to the bond pads of the printhead die; providing a printhead frame including an ink delivery surface, a latch and a bracket; inserting the extension from the second end wall of the die mount substrate into the bracket; providing a sealing member between the ink receiving surface and the ink delivery surface; and closing the latch to engage the latchable projection of the die mount substrate.

14 Claims, 19 Drawing Sheets

METHOD FOR ASSEMBLING AN INKJET PRINTHEAD

CROSS REFERENCE TO RELATED APPLICATIONS

Reference is made to commonly assigned U.S. patent application Ser. No. 12/750,744 filed Mar. 31, 2010 by Richard Murray, entitled "Snap-In Die Mount Assembly For Inkjet Printhead", the disclosures of which are herein incorporated by reference.

FIELD OF THE INVENTION

The present invention relates generally to a die mount assembly for an inkjet printhead, and more particularly to a die mount substrate and associated printhead features that facilitate assembling of the printhead.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink is depleted. Carriage mounted ink tanks typically contain only enough ink for up to about several hundred prints. This is because the total mass of the carriage needs be limited so that accelerations of the carriage at each end of the travel do not result in large forces that can shake the printer back and forth. As a result, users of carriage printers need to replace carriage-mounted ink tanks periodically depending on their printing usage, typically several times per year. Consequently, the task of replacing a detachably mounted ink tank should be simple and reliable within the printer.

The printhead nozzle array is fabricated, for example, on a silicon wafer that is then separated into many printhead die. The printhead die includes not only one or more nozzle arrays, but also electrical interconnect pads to receive signals from the printer controller, and fluid inlets to receive ink from corresponding ink supplies in the printer. In order to keep the fabrication costs of the printhead die low, the feature size on the printhead die is small so that the die size can be small and many die can be made on a single wafer. As a result, microelectronic and microfluidic packaging of the printhead die are required in order to facilitate a user installing it in the printer in such a way that electronic connections and fluidic connections are reliably made, with the nozzle arrays suitably aligned to provide excellent image quality. Typically one or more printhead die are adhered to a die mount substrate that includes fluid passageways corresponding to the fluid inlets on the printhead die. A separate electrical interconnect member, such as a flex circuit that includes bond pads for interconnection with the printhead die and an array of contact pads for connection to the printer, is also attached with the bond pads near the printhead die. The die mount substrate is then mounted to a printhead frame using screws, heat staking or other such fasteners.

U.S. Pat. No. 5,652,610 discloses a printhead die 1300 mounted on a substrate 1310 that is attached to an ink 1000 using a snap-fit and hinged closure 1200 (see FIG. 3). Although it is indicated in column 4 of U.S. Pat. No. 5,652,610 that the ink tank and the ink head may be separable from one another, it appears that this would be unwieldy for the user to do in a printer because the substrate 1310 is sandwiched between the ink tank 1000 and the closure 1200.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, or to have a smaller drop volume than intended, or to fail to eject. Air bubbles can arise from a variety of sources. Air that enters the ink supply through a non-airtight enclosure can be dissolved in the ink and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

Commonly assigned U.S. patent application Ser. No. 12/614,487 discloses removal of air from the ink in a printhead, as well as ink chamber and die mount substrate geometries that can facilitate air bubble removal. The disclosed ink chamber and die mount substrate geometries provide a more vertical pathway in the printhead for air bubble flow from the printhead die and from the ink inlet ports to an air space above the liquid ink level in the ink chambers from which the air can then be extracted. In particular, the ink chambers have a staggered outlet port configuration, and the die mount substrate includes ink pathways having a staggered ink inlet configuration to receive ink from outlet ports of the ink chambers.

What is needed is a compact die mount substrate that facilitates low-cost easy assembly onto a printhead frame, and particularly for a printhead frame that allows replacement of detachable ink tanks within an inkjet printer. In addition in some embodiments, the die mount substrate should be compatible with a staggered ink inlet configuration at the ink receiving surface of the die mount substrate.

SUMMARY OF THE INVENTION

The present invention is directed to overcoming one or more of the problems set forth above. Briefly summarized, according to one aspect of the invention, the invention resides in a method of assembling an inkjet printhead, the method comprising the steps of providing a die mount substrate including a die mount surface, an ink receiving surface, a first end wall having a latchable projection and a second end wall having an extension; providing a printhead die including at least one nozzle array and a plurality of bond pads; attaching the printhead die to the die mount surface of the die mount substrate; providing a wiring member; adhering a portion of the wiring member to the die mount surface of the die mount substrate; electrically interconnecting the wiring member to the bond pads of the printhead die; providing a printhead frame including an ink delivery surface, a latch and a bracket; inserting the extension from the second end wall of the die mount substrate into the bracket; providing a sealing member between the ink receiving surface and the ink delivery surface; and closing the latch to engage the latchable projection of the die mount substrate.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
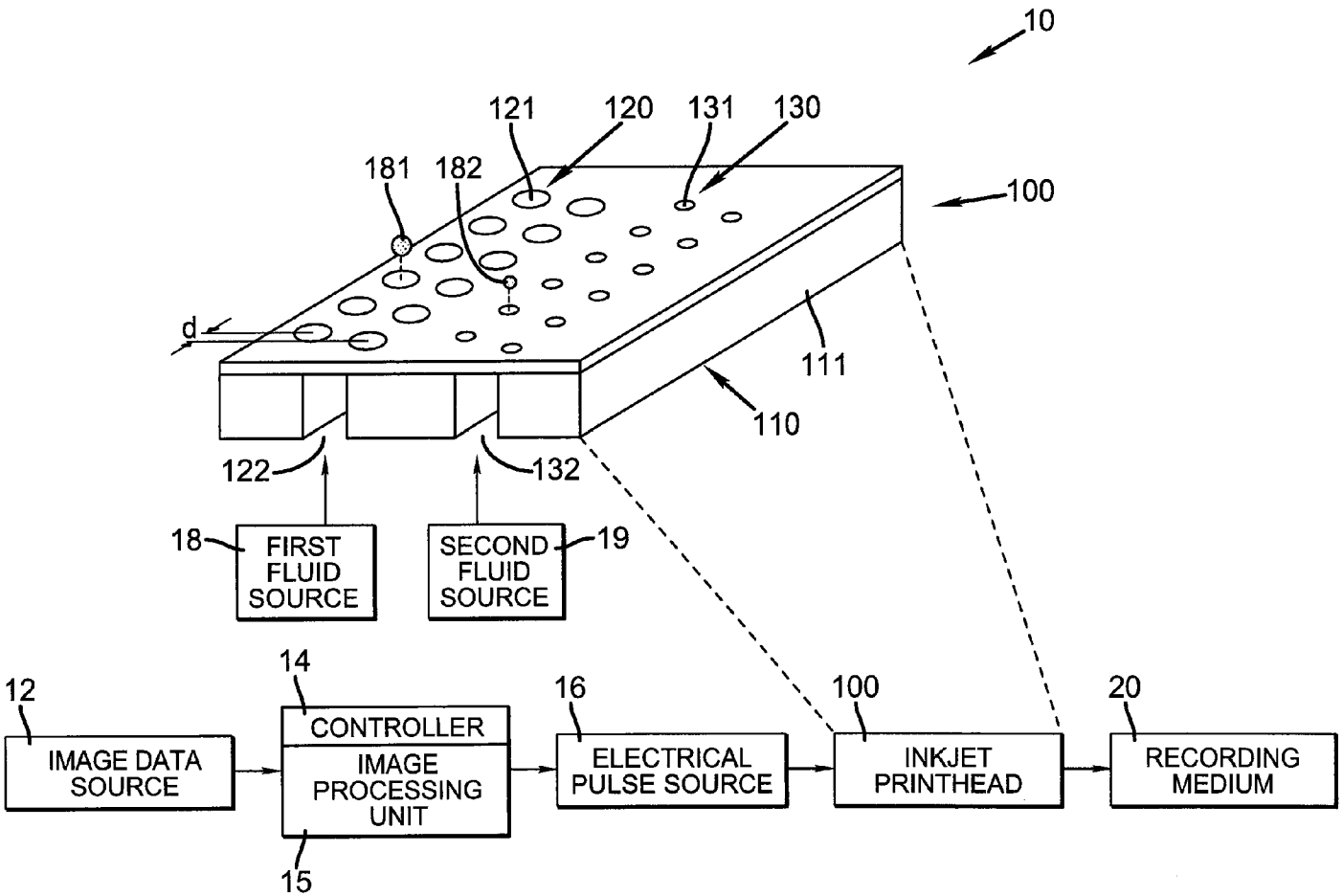
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. Each nozzle array is supplied by a fluid source. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
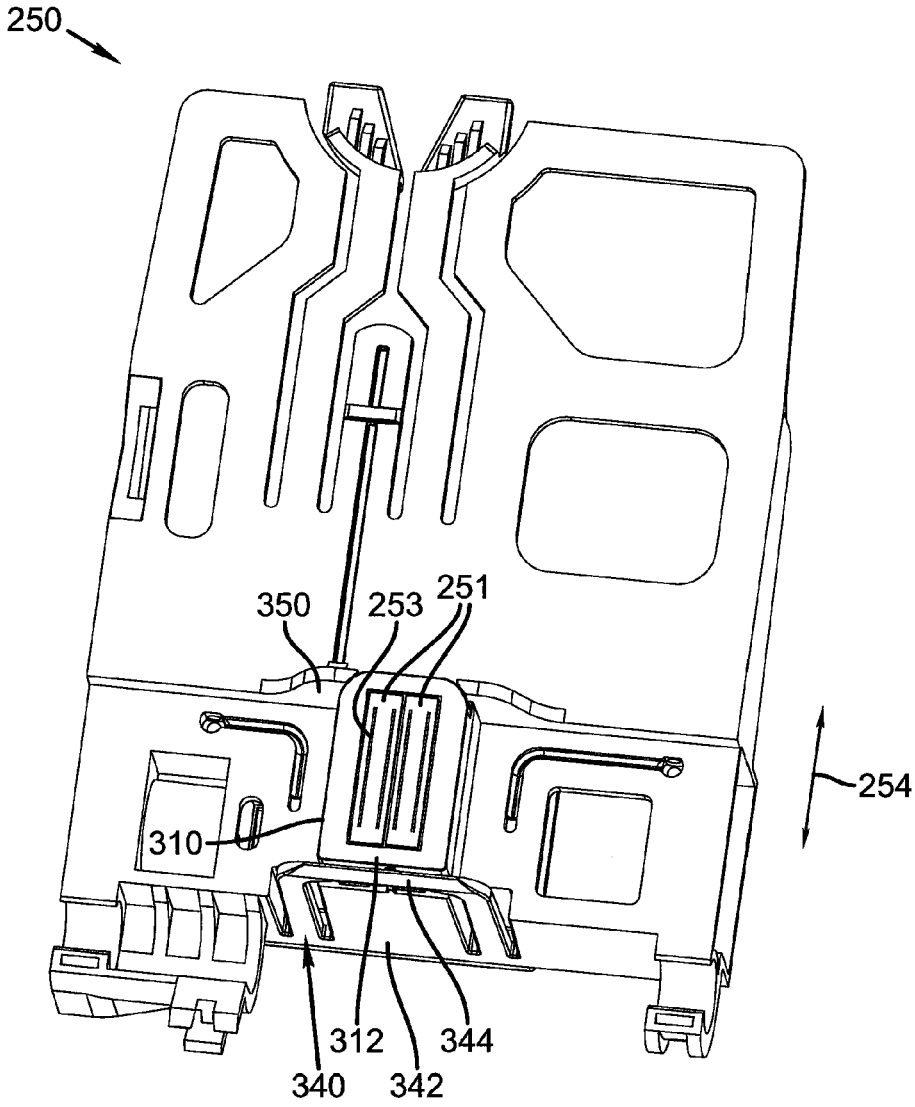
FIG. 2 is a bottom perspective view of a printhead assembly, according to an embodiment of the invention.

FIG. 2 shows a bottom perspective view of a printhead assembly 250, which is an example of an inkjet printhead 100. The printhead assembly includes printhead frame 250, as well as two printhead die 251 (similar to printhead die 110 in FIG. 1) mounted on die mount surface 312 of die mount substrate 310. Each printhead die 251 containing two nozzle arrays 253 so that printhead assembly 250 contains four nozzle arrays 253 altogether. The die mount substrate 310 is held in place near face 342 of printhead frame 250 by bracket 350 and by latching bar 344 of latch 340, according to an embodiment of the present invention as is described in more detail below. The four nozzle arrays 253 in this example can each be connected to separate ink sources (not shown in FIG. 2); such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead frame 250 across the recording medium 20. Following the printing of a swath, the recording medium 20 is advanced along a media advance direction that is substantially parallel to nozzle array direction 254.

Figure 3:
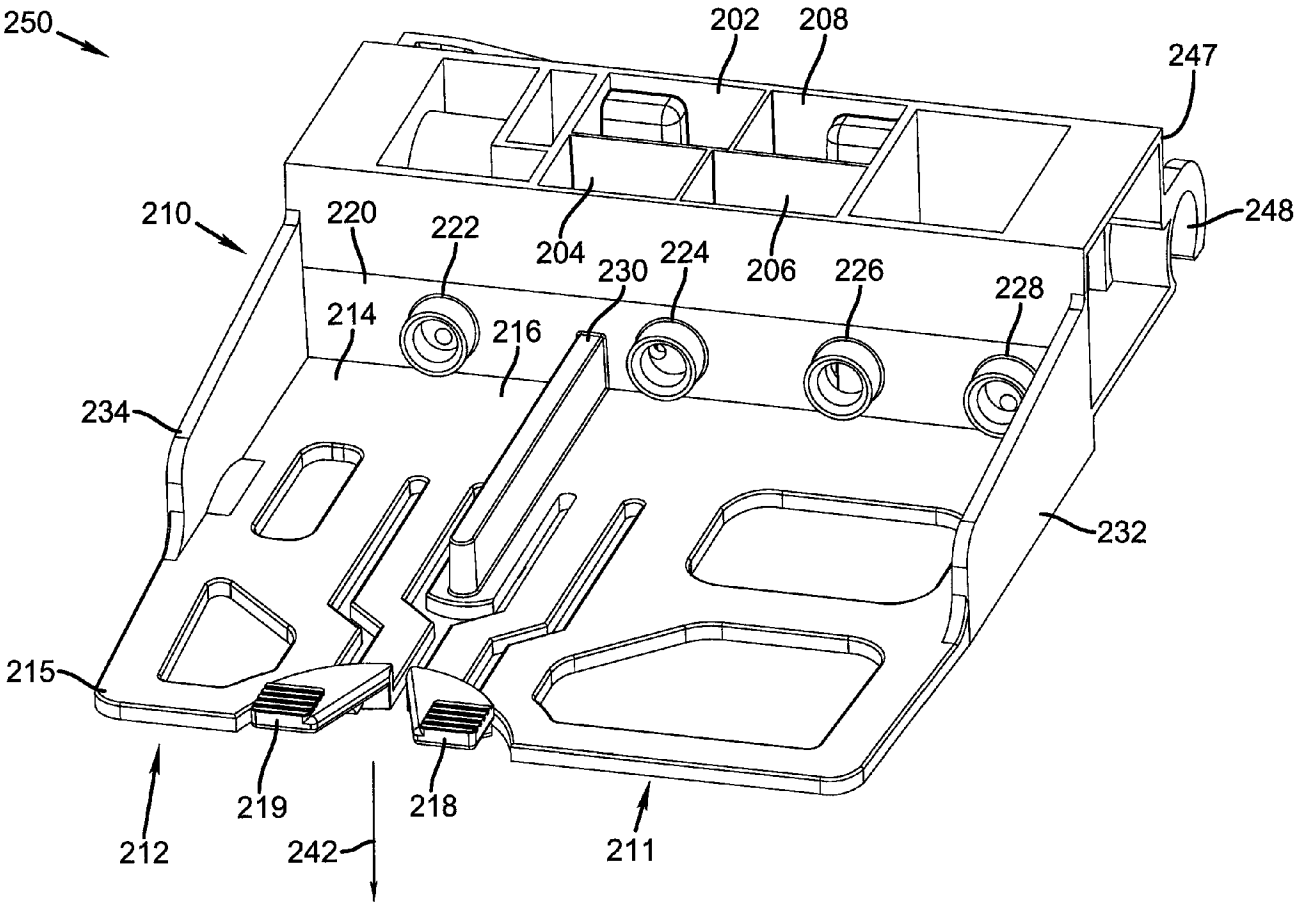
FIG. 3 is a perspective view of a printhead frame including a holding receptacle for two detachable ink tanks.
Figure 4:
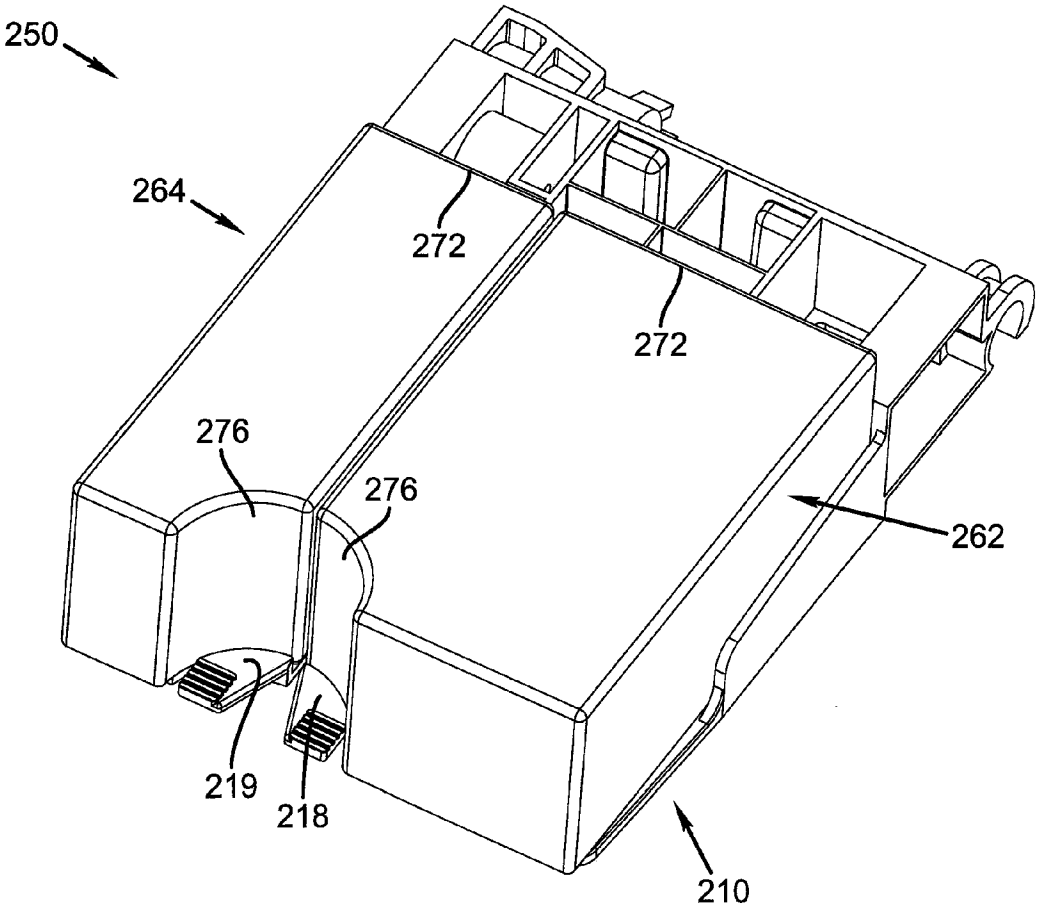
FIG. 4 is a perspective view of the printhead frame of FIG. 3 with two detachable ink tanks installed in the holding receptacle.

FIG. 3 shows a front perspective view of printhead frame 250 including holding receptacle 210 for ink tanks 262 and 264 (see FIG. 4). As described in more detail in commonly assigned U.S. patent application Ser. No. 12/750,729 holding receptacle 210 includes a first part 211 for holding a multi-chamber ink tank 262 and a second part 212 for holding a single chamber ink tank 264. Holding receptacle 210 includes a base surface 214 for supporting the ink tanks. Base surface 214 has a first end 215 and a second end 216 that is opposite first end 215. Tank latch 218 is located near the first end 215 of the base surface 214 of first part 211 of holding receptacle 210, and tank latch 219 is located near the first end 215 of the base surface 214 of second part 212 of holding receptacle 210 for retaining the respective ink tanks. Wall 220 is located near the second end 216 of base surface 214 and adjoins base surface 214. Wall 220 includes ink inlet ports 224, 226 and 228 corresponding to first part 211 of holding receptacle 210, and also includes ink inlet port 222 corresponding to second part 212 of holding receptacle 210. Ink inlet ports 222, 224, 226 and 228 are connected to ink chambers 202, 204, 206 and 208, which are arranged in two rows, as is described in more detail in commonly assigned U.S. patent application Ser. No. 12/750,752. The ink inlet ports are configured to receive ink from ink tanks 262 and 264 from ink outlet ports (not shown) at end walls 272 (see FIG. 4) of ink tanks 262 and 264. Partition 230 adjoins both base surface 214 and wall 220, and is located between a portion of first part 211 and a portion of second part 212 of holding receptacle 210. First sidewall 232 of holding receptacle 211 also adjoins both base surface 214 and wall 220. Second sidewall 234 of holding receptacle 210 is opposite first sidewall 232 and is substantially parallel to it. Partition 230 is located between first sidewall 232 and second sidewall 234. Partition 230 adjoins wall 220 between ink inlet port 222 and ink inlet port 224. Tank latches 218 and 219 are preferably cantilevered latches that extend from base surface 214 and latches against walls 276 (see FIG. 4) of ink tanks 262 and 264 respectively. If cantilevered latch 218 or 219 is depressed along pressing direction 242, it can be relocated to an unlatching position, which is below base surface 214.

In some embodiments for a carriage printer, printhead frame 250 also has at least one bearing surface 248, which can be integrally formed together with holding receptacle 210. Bearing surface 248 is intended to ride on a carriage guide in the carriage printer, so that printhead frame 250 also serves as the carriage. A belt attach member 249 (see FIGS. 6 and 18) can also be integrally formed with printhead frame 250 for moving it along the carriage guide within the printer. In fact, all of the labeled features in FIG. 3 can be integrally formed, for example, in a single injection molding step. This decreases the cost of forming and assembling the printhead and carriage while retaining the required functionality. It can also make the design more compact.

Figure 5:
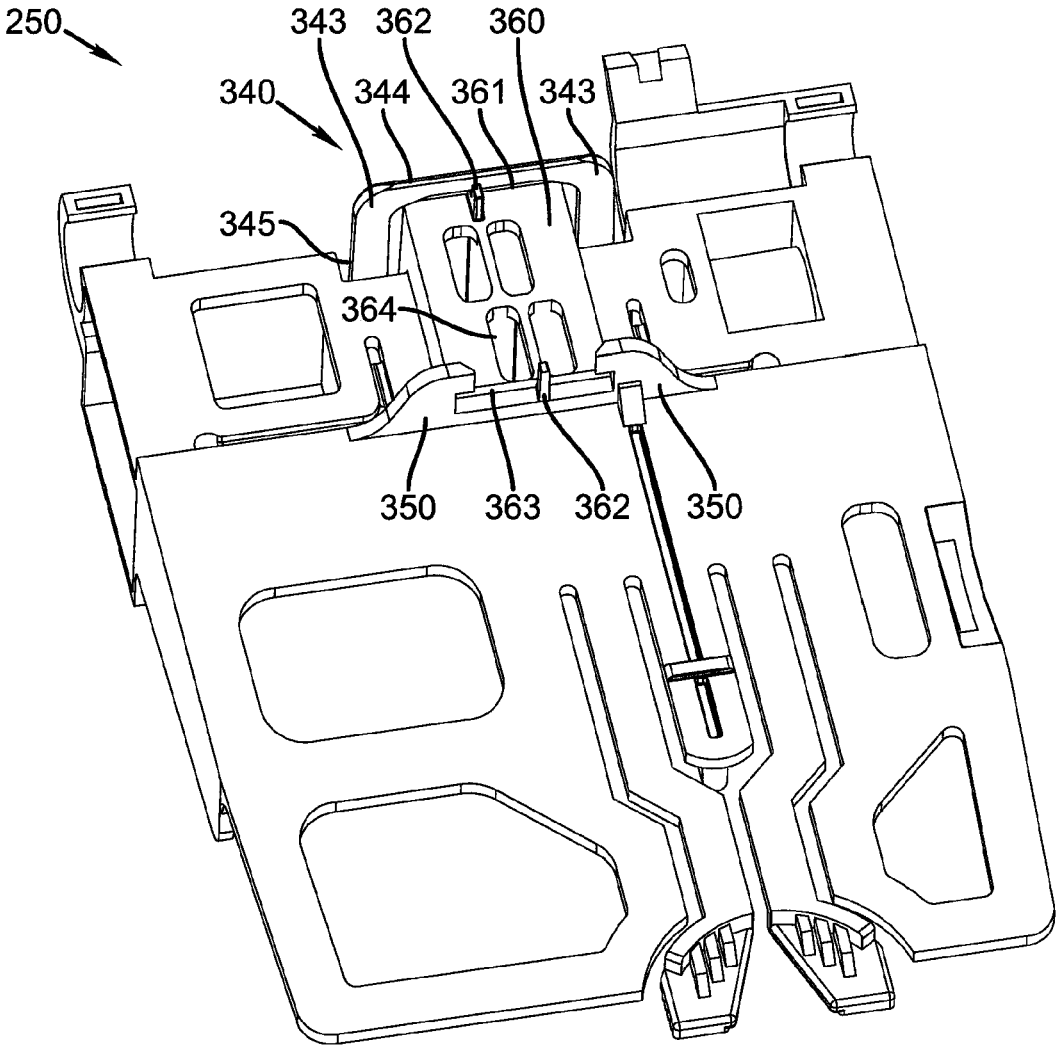
FIG. 5 is a bottom perspective view of a printhead frame portion of the printhead assembly of FIG. 2.
Figure 6:
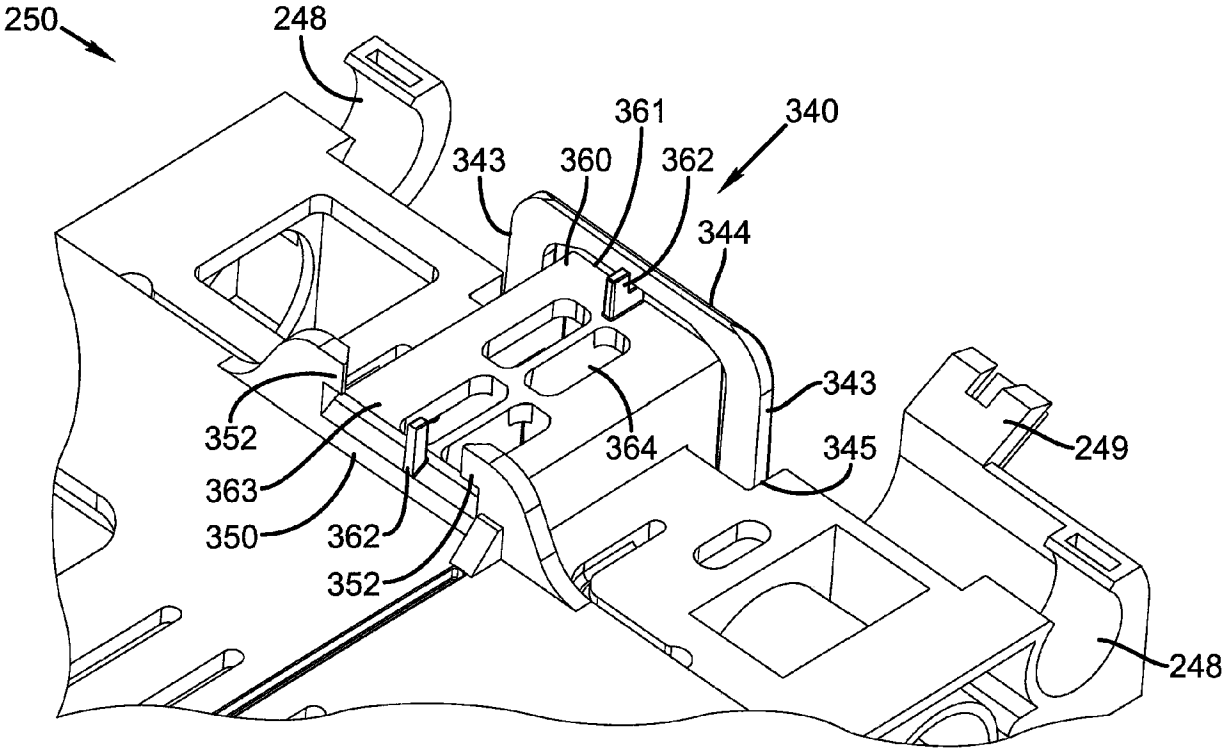
FIG. 6 is a close-up view of a portion of the printhead frame of FIG. 5.
Figure 7:
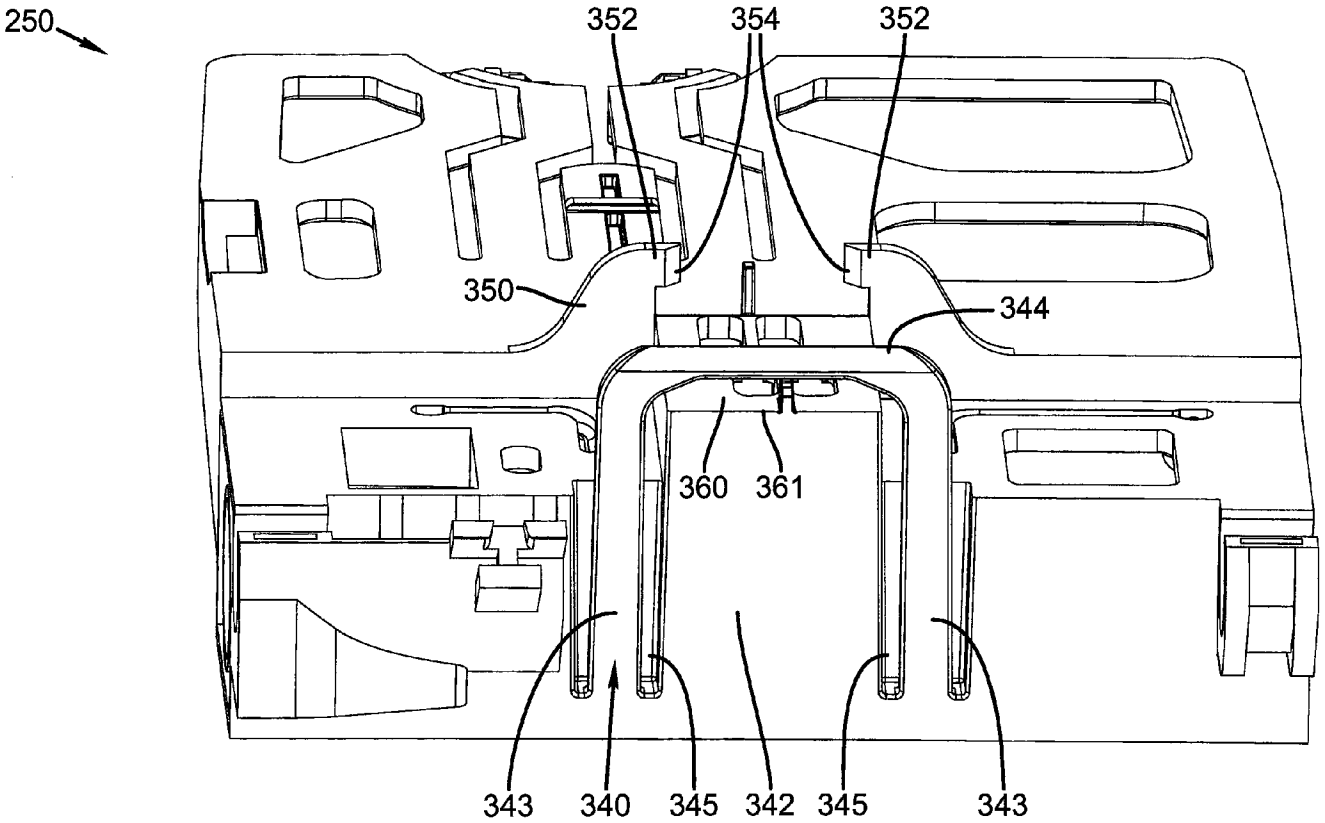
FIG. 7 is a low angle view of the printhead frame of FIG. 5.
Figure 8:
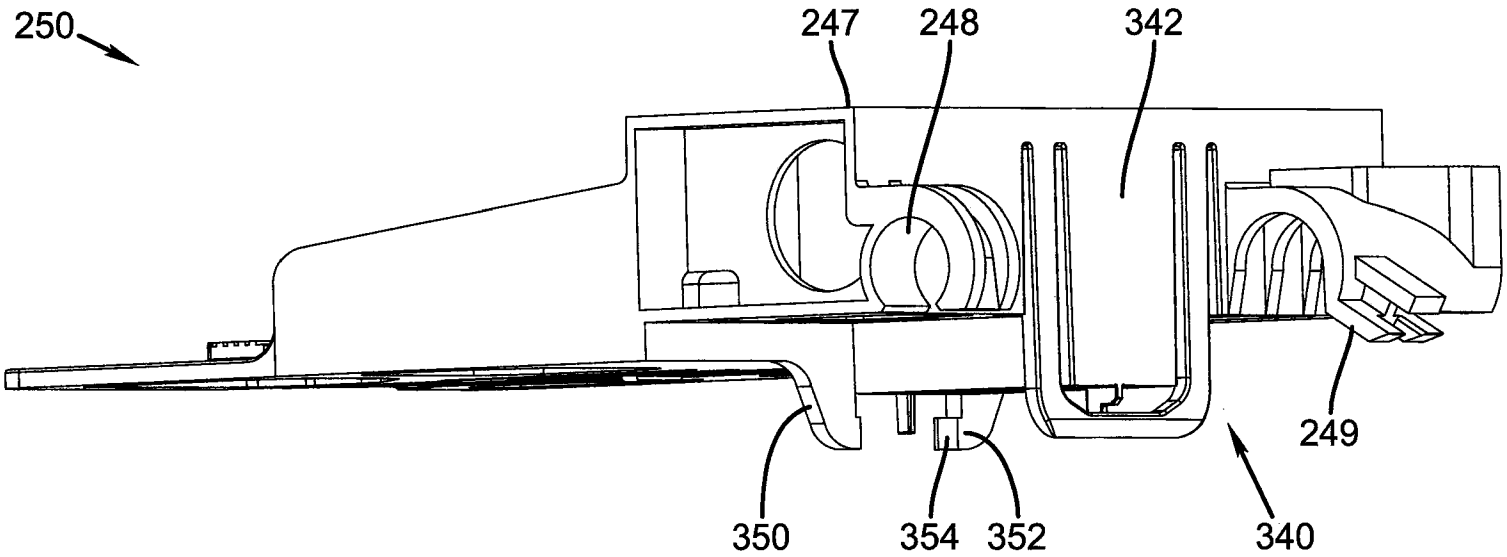
FIG. 8 is a perspective view of the printhead frame of FIG. 5

FIG. 5 is a bottom perspective view of printhead frame 250, rotated from the view of FIG. 2, such that latch 340 is away from the viewer rather than toward the viewer. FIG. 6 is a close-up view of the portion of printhead frame 250 to which the die mount substrate 310 (FIGS. 2 and 9) can be attached by snapping it in place. FIG. 7 is a low-angle view of printhead frame 250 as viewed facing latch 340. FIG. 8 is a view of printhead frame 250 facing corner 247 (see FIG. 2). Die mount substrate 310 is not shown in FIGS. 5-8.

As shown in FIGS. 5-7, printhead frame 250 includes an ink delivery surface 360 including a plurality of ink delivery openings 364. The four ink delivery openings 364 shown in FIG. 5 are respectively connected to ink chambers 202, 204, 206 and 208 shown in FIG. 2, and are arranged in two rows similar to the ink chambers. In other words, at least one of the ink delivery openings 364 is located near first end 361 of ink delivery surface 360, and at least one of the ink delivery openings 364 is located near second end 363 of ink delivery surface 360. Adjoining a first end 361 of ink delivery surface 360 is face 342 of printhead frame 250 (FIG. 7). Latch 340 is located near face 342. Bracket 350 is located at a second end 363 of the ink delivery surface 340 opposite the first end. Face 342 includes two recesses 345, a first one being located on one side of ink delivery surface 360 and a second one being located on the other side. Latch 340 includes two arms 343, each of which extends from one of the recesses 345. Latch 340 also includes a latching bar 344 that extends between the first and second arms 343 and that is configured to engage with at least one latchable projection 314 (see FIG. 9) of die mount substrate 310. Ink delivery surface 360 also includes at least one alignment feature 362 that engages with at least one alignment feature 322 on an ink receiving surface 320 of die mount substrate 310 (see FIG. 10). In the embodiment shown in FIGS. 5, 6 and 10, alignment features on ink delivery surface 360 of printhead frame 250 include a first rib 362 located near first end 361 and a second rib 362 located near second end 363 of ink delivery surface 360. Corresponding alignment features 322 on ink receiving surface 320 of die mount substrate 310 include a first groove 322 near a first end wall 313 and a second groove 322 near a second end wall 315 of die mount substrate 310 (see FIG. 10).

Figure 9:
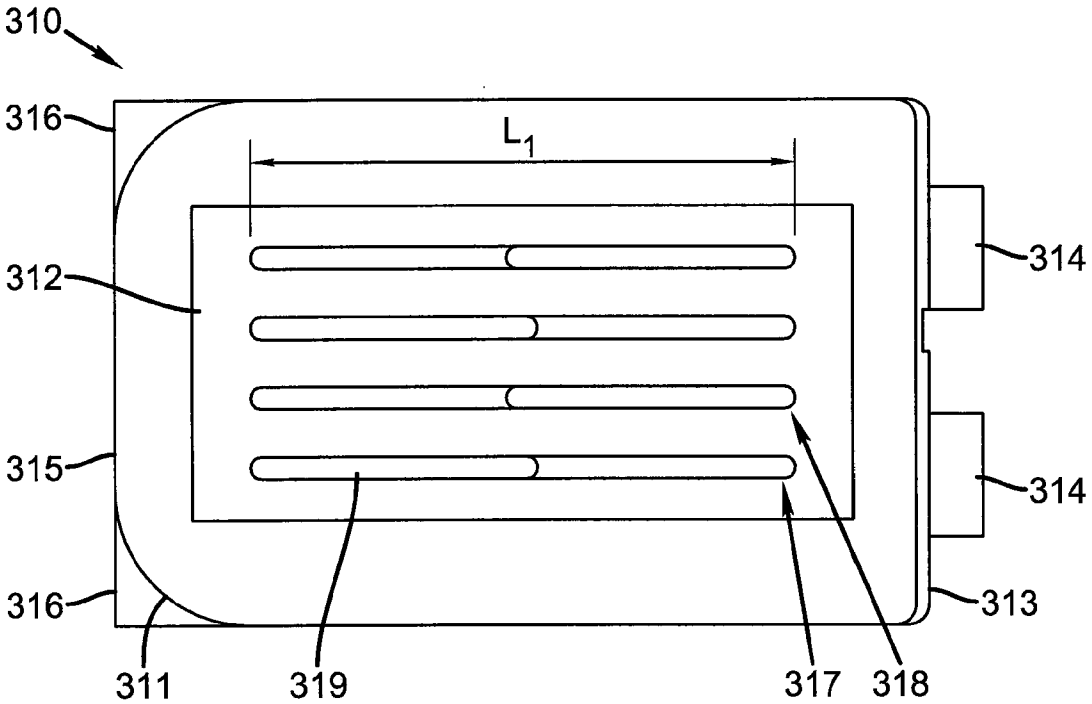
FIG. 9 is a view of a die mount surface of a die mount substrate according to an embodiment of the invention.
Figure 10:
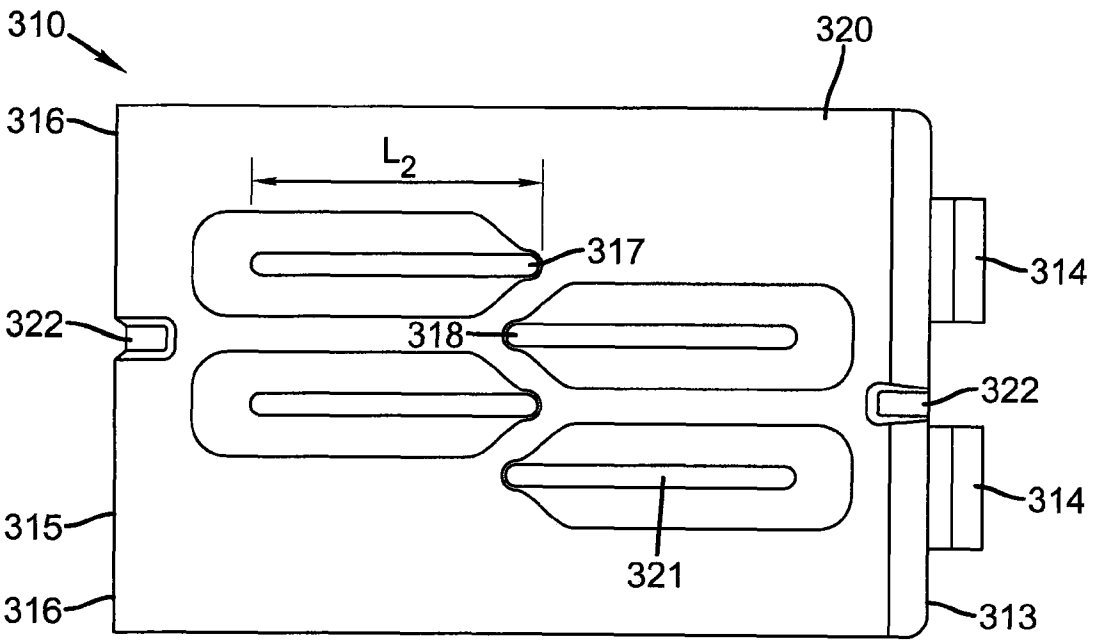
FIG. 10 is a view of an ink receiving surface of the die mount substrate of FIG. 9.
Figure 11:
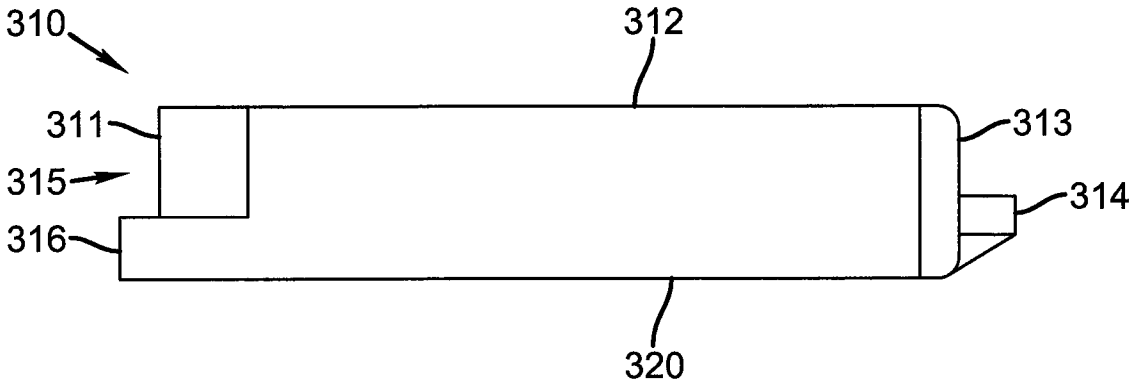
FIG. 11 is a side view of the die mount substrate of FIG. 9.

FIG. 9 shows die mount surface 312 of die mount substrate 310, while FIG. 10 shows an ink receiving surface 320 that is opposite die mount surface 312. FIG. 11 shows a side view of die mount substrate 310. At least one latchable projection 314 (a first projection 314 and a second projection 314 are shown in FIGS. 9 and 10) extends from first end wall 313, which is disposed between die mount surface 312 and ink receiving surface 320. In the example shown in FIGS. 9-11, the first and second latchable projections 314 are indented from the sidewalls that join the first end wall 313 and a second end wall 315 that is opposite first end wall 313. In that way, latch 340 can have arms 343 positioned outside the two latchable projections 314 without requiring excessive distance between the two arms 343. In addition, at least one extension 316 (a first extension 316 and a second extension 316 are shown in FIGS. 9 and 10) extends from second end wall 315. In the example shown in FIGS. 9-11, the first and second extensions 316 are at the corners of second end wall 315 and are near the ink receiving surface 320. A plurality of ink passageways 317 and 318 (plus two others) are shown extending from ink receiving surface 320 to die mount surface 312. Printhead die 251 (FIG. 2) have an elongated ink inlet slot (not shown) that extends along each nozzle array 253. Correspondingly, adjacent ink passageways 317 and 318 have adjacent first slot openings 319 of length $L_1$ on the die mount surface 312 to feed ink to the elongated ink inlet slots of the printhead die 251. On the ink receiving surface 320 ink passageways 317 and 318 have a second slot opening 321 with a second length $L_2$, where the second length $L_2$ is less than the first length $L_1$. Second slot opening 321 for ink passageway 317 is located near second end wall 315, while second slot opening 321 for ink passageway 318 is located near first end wall 313. In this way, the second slot openings 321 for adjacent ink passageways 317 and 318 can be fluidly connected to corresponding staggered adjacent ink delivery openings 364 on ink delivery surface 360 near first end 361 and second end 363 (see FIG. 5).

In the printhead assembly including die mount substrate 310 attached to printhead frame 250, bracket 350 of printhead frame 250 includes a first finger 352 and a second finger 352 (FIG. 6) to retain the first and second extensions 316 (FIGS. 9-11) respectively of die mount substrate 310. In addition, butting portions 311 of second end wall 315 are configured to butt against a surface 354 (FIG. 8) of the two fingers 352 of bracket 350.

Figure 12:
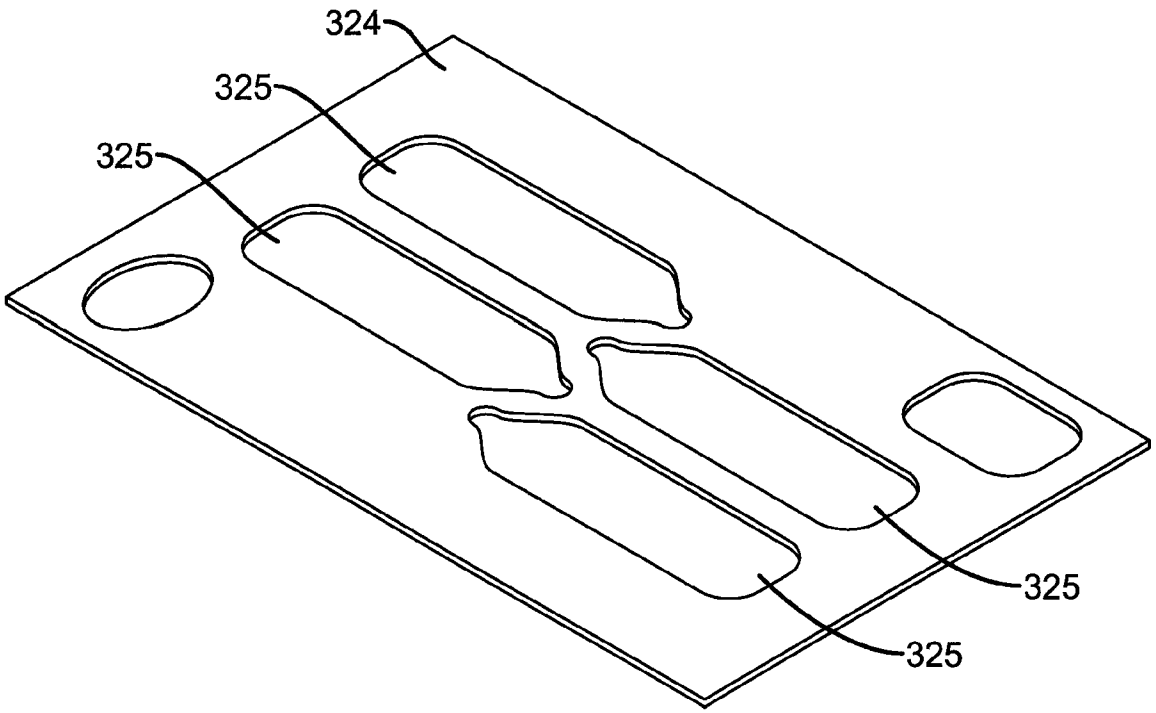
FIG. 12 is a view of a sealing member according to an embodiment of the invention.

In order to provide reliable fluidic connection between ink receiving surface 320 of die mount substrate 310 and ink delivery surface 360 of printhead frame 250, a sealing member 324 (FIG. 12) is disposed between ink receiving surface 320 and ink delivery surface 360 when die mount substrate 310 is installed on printhead frame 250. Sealing member 324 can be an elastomeric gasket, or an adhesive seal for example. Openings 325 in sealing member 324 correspond to second slot openings 321 on ink receiving surface 320 and also to ink delivery openings 364 on ink delivery surface 360.

Figure 13:
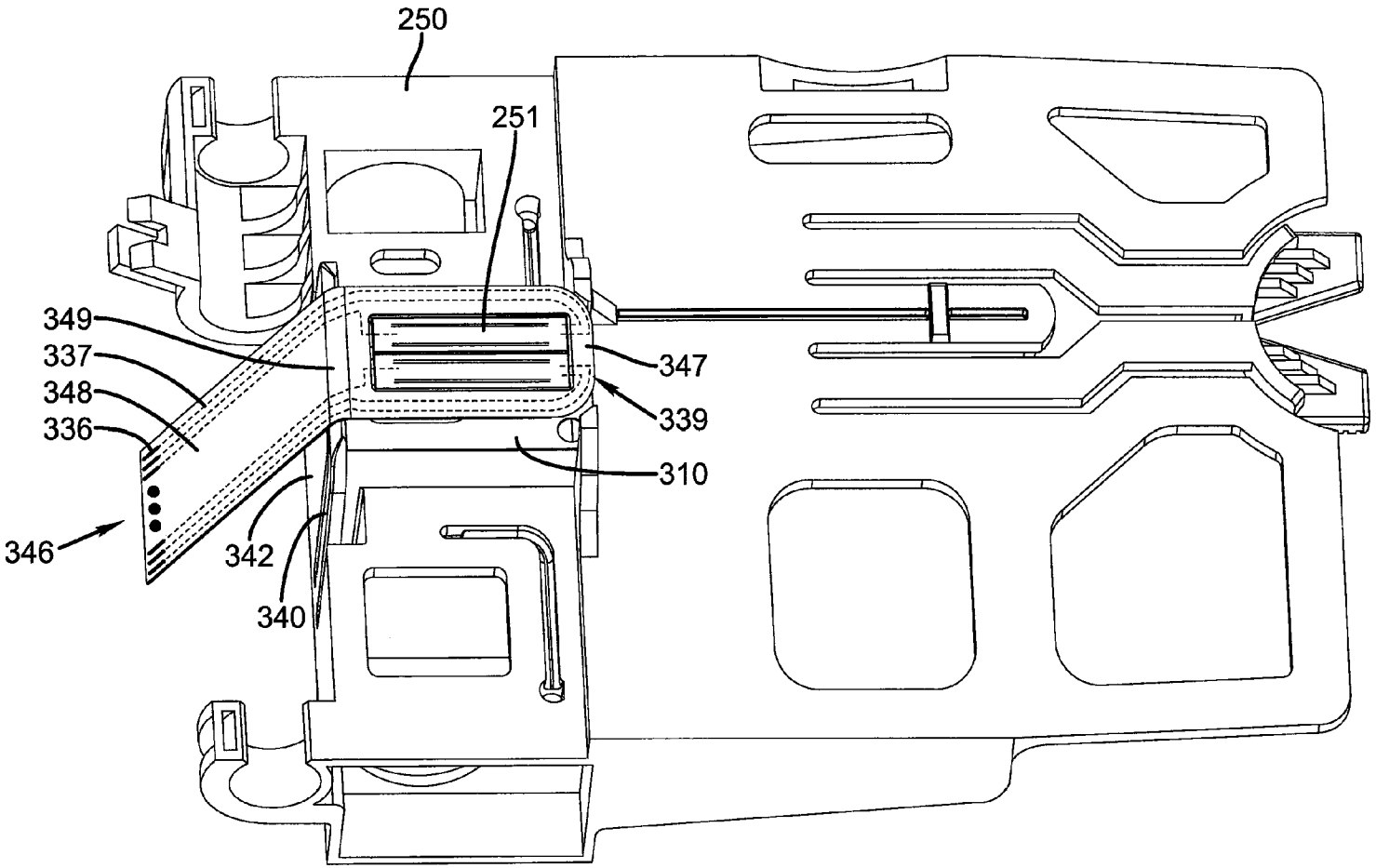
FIGS. 13-16 are views of the printhead assembly of FIG. 2, also including a wiring member according to an embodiment of the invention.
Figure 14:
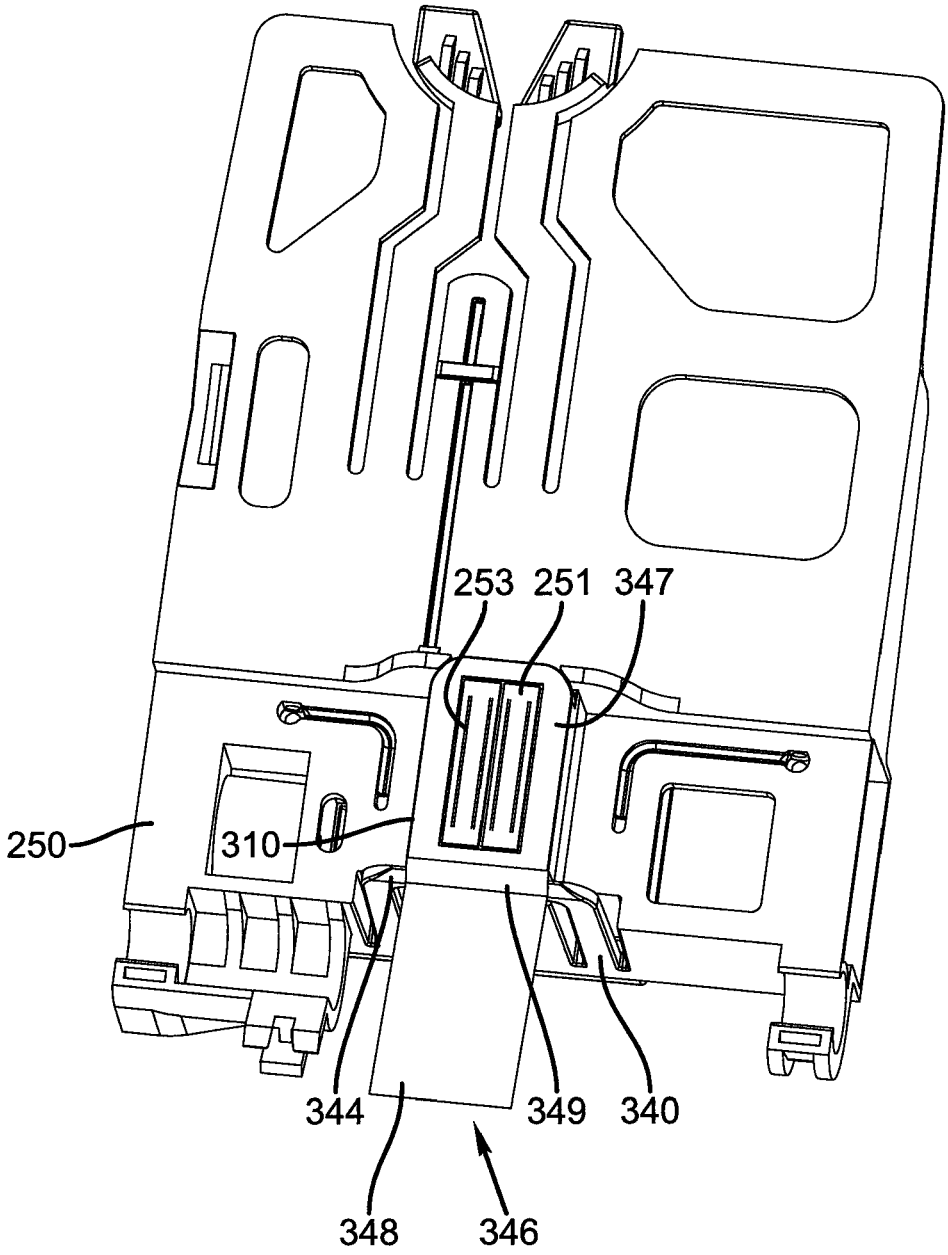
Figure 15:
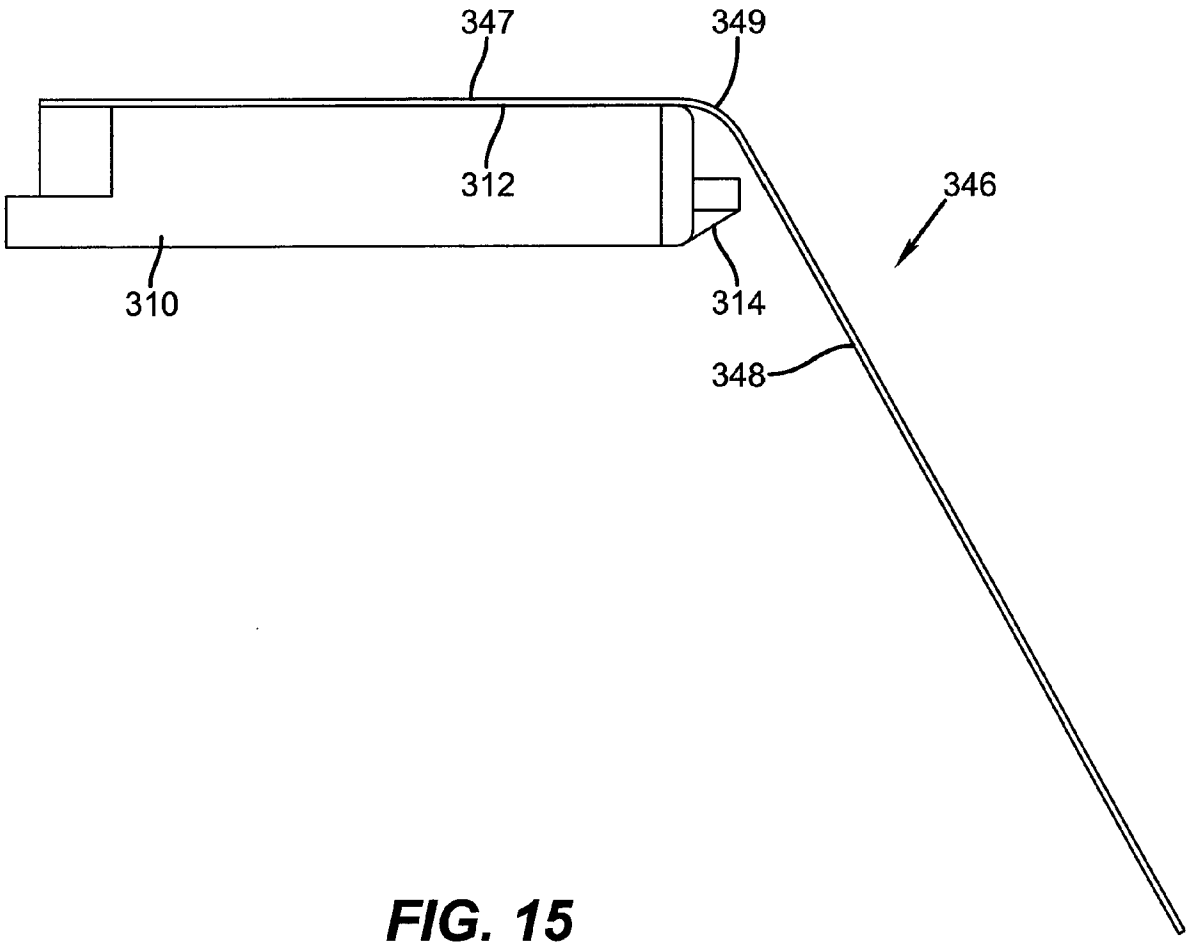

The printhead assembly also includes wiring member 346, as shown in perspective views of FIGS. 13 and 14, as well as in the side view of FIG. 15. As shown in FIG. 13, wiring member 348 includes connection pads 336 that mate with an electrical connector in the inkjet printer, as well as leads 337 (dashed lines) that terminate at pads (not shown) near printhead die 251 for electrical interconnection to bond pads of printhead die 251. Although the pads and bond pads are not explicitly shown, wire bonds 339 (as one example of electrical interconnection) are shown in FIG. 13. A first portion 347 of wiring member 346 is adhered to die mount surface 312 of die mount substrate 310, prior to attaching die mount substrate 310 to printhead frame 250, in order to provide a stable structure for electrical interconnection. In order to stabilize the latching bar 344 of latch 340 such that latch 340 securely holds latchable projection(s) 314 of installed die mount substrate 310, a second portion 348 of wiring member 346 is adhered to face 342, and a third portion 349 of wiring member 346 is wrapped around latching bar 344 of latch 340. (The wrapping of wiring member 346 around latching bar 344 is shown in FIGS. 13-15, but the adhering of wiring member 346 to face 342 is not shown for clarity.)

Figure 16:
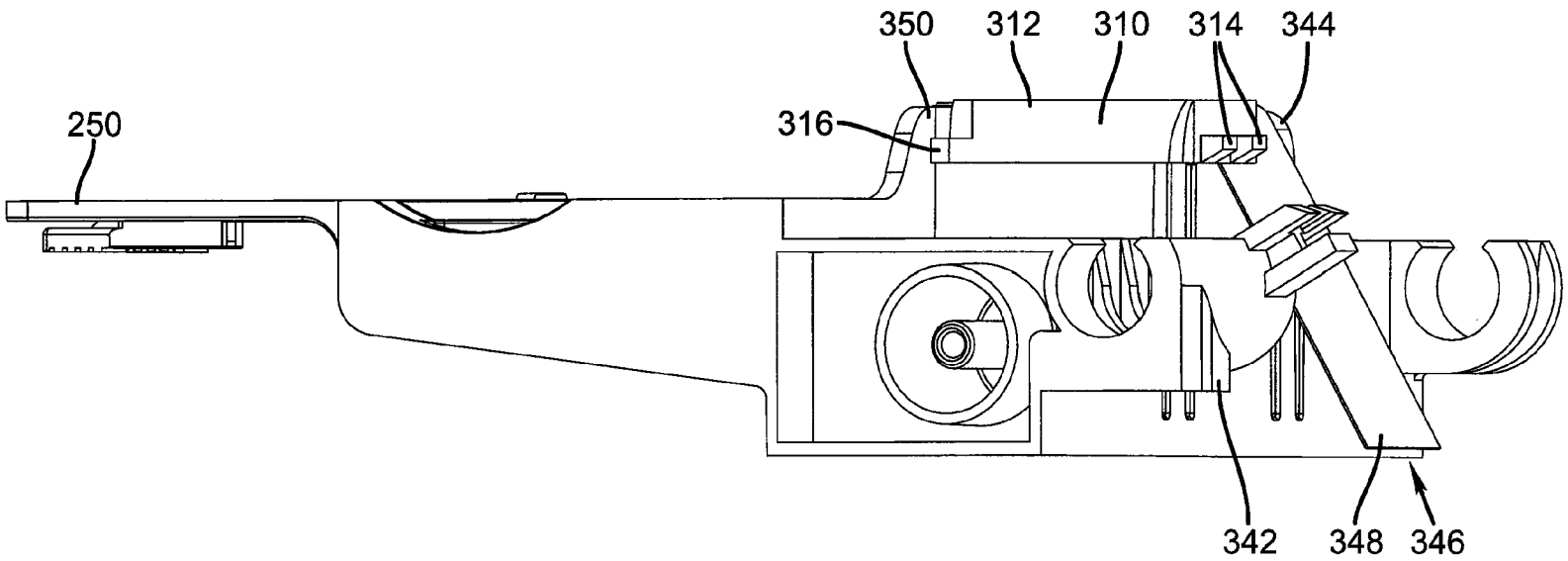

FIG. 16 is a perspective view of die mount substrate 310 and wiring member 346 installed onto printhead frame 250 with die mount surface 312 facing up, but prior to adhering second portion 348 of wiring member 346 to face 342. Bracket 350 retains extensions 316 of die mount substrate 310, while latching bar 344 holds latching projections 314 of die mount substrate 310.

Having described the various features of die mount substrate 310 and printhead frame 250, a context is provided for describing a method of assembling an inkjet printhead according to an embodiment of the invention. Die mount substrate 310 is also referred to as a snap-in die mount substrate because of the method of assembly. Die mount substrate 310 is provided (for example by injection molding or by forming a ceramic part), including a die mount surface 312, an ink receiving surface 320, a first end wall 313 having a latchable projection 314 and a second end wall 315 having an extension 316. Die mount surface 312 typically includes at least one first slot opening 319. A printhead die 251 is provided including at least one nozzle array 253 and a plurality of bond pads. Printhead die 251 typically includes at least one ink feed slot that provides ink to nozzle array 253. Printhead die 251 is attached to the die mount surface 312 of the die mount substrate 310, typically applying an adhesive to the die mount surface 312 around the first slot opening(s) 319. Printhead die 251 is aligned such that the ink feed slot confronts the first slot opening 319 of die mount surface 312 with the adhesive contacting printhead die 251. The adhesive is then cured. A portion 347 of wiring member 346 is adhered to the die mount surface 312 of the die mount substrate 310 in order to position pads of the wiring member 346 in proximity to the bond pads of printhead die 251. Electrical interconnection between the bond pads of printhead die 251 and wiring member 346 can be done using wire bonding, tape automated bonding, or other such microelectronic interconnection technologies. Typically these electrical interconnections would be then encapsulated for protection. Printhead frame 250 is provided (for example by injection molding) including an ink delivery surface 360, a latch 340 and a bracket 350. Extension 316 from second end wall 315 of die mount substrate 310 is inserted into bracket 350 of printhead frame 250. A sealing member 324 is provided between the ink receiving surface 320 of die mount substrate 310 and the ink delivery surface 360 of printhead frame 250. Latch 340 is closed to engage the latchable projection 314 extending from the first end wall 313 of die mount substrate 310.

Different embodiments of the method can include additional alternative steps. Sealing member 324 can be provided as an elastomeric gasket, or can be provided as an adhesive that is applied to one or both of the ink delivery surface 360 or the ink receiving surface 320. After the extension 316 has been inserted into bracket 350, typically with the ink receiving surface 320 of die mount substrate 310 inclined at an angle with respect to the ink delivery surface 360, the two surfaces 320 and 360 are brought into a confronting position. This can be done, for example, by pivoting the die mount substrate 310 about the extension 316 within bracket 350 with the sealing member 324 disposed between the two surfaces prior to closing latch 340. As the two surfaces 320 and 360 are being brought into a confronting position, latch 340 can be displaced to an open position. After the two surface 320 and 360 are in a confronting position, closing the latch 340 can be done by allowing the latch 340 to snap back into a normally closed position. In order to provide alignment between die mount substrate 310 (together with mounted printhead die 251) and printhead frame 250, bringing the two surfaces 320 and 360 into a confronting position can also include mating an alignment feature 322 on the ink receiving surface 320 of die mount substrate 310 with an alignment feature 362 on the ink delivery surface 360 of printhead frame 250. Following the closing of the latch 340 the latch 340 can be further secured by wrapping a portion 349 of wiring member 346 around latching bar 344 of latch 340 and attaching (for example by an adhesive) a portion 348 of wiring member 346 to face 342 of printhead frame 250

Figure 17:
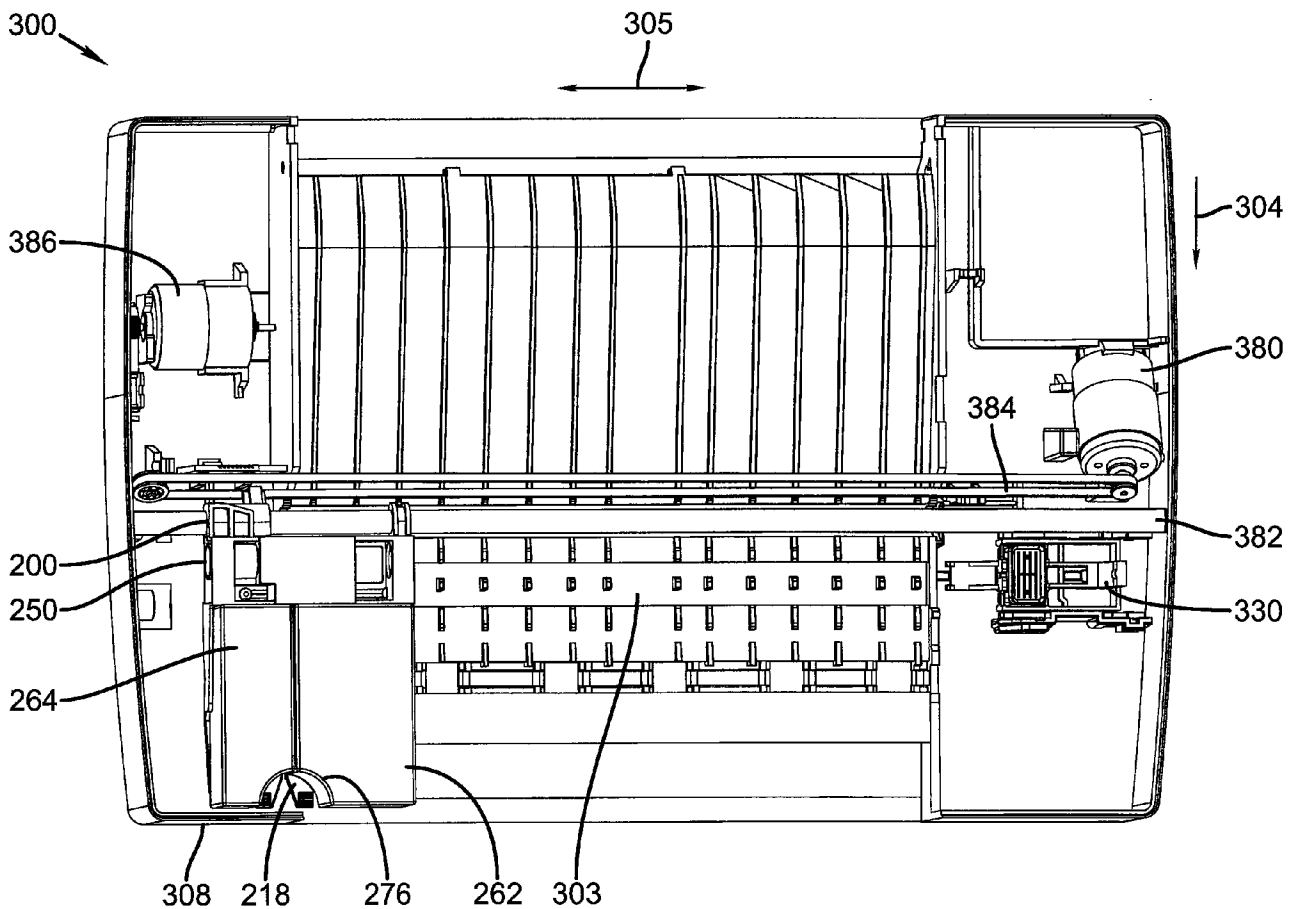
FIG. 17 is a top view of a portion of a carriage printer according to an embodiment of the invention.

FIG. 17 shows a top view of a desktop carriage printer 300 according to an embodiment of the invention. Some of the parts of the printer have been hidden in the view shown in FIG. 17 so that other parts can be more clearly seen. Printer 300 has a print region 303 across which carriage 200 is moved back and forth in carriage guide direction 305, while drops are ejected from nozzle array 253 on printhead die 251 (not shown in FIG. 20) on printhead frame 250 that is mounted on carriage 200. Die mount substrate 310 (not shown in FIG. 17) is aligned to printhead frame 250 (by alignment features 322 and 362 described above relative to FIGS. 5, 6 and 10) such that nozzle arrays 253 are disposed along a nozzle array (FIG. 2) direction 254 that is substantially perpendicular to carriage guide direction 305. In some embodiments, printhead frame 250 is integrally formed with carriage 200 as described above. Carriage motor 380 moves belt 384 to move carriage 200 along carriage guide 382.

Multichamber ink tank 262 and single chamber ink tank 264 are mounted in the holding receptacle of printhead frame 250. Tank latch 218 latches against wall 276 of multichamber ink tank 262. Printer 300 includes a base 309 on which the printer rests during operation (see FIGS. 18 and 19). A front wall 308 extends upward from base 309. To facilitate compact design and reduced cost of printer 300, the ends of tank latch 218 and tank latch 219 are disposed less than 5 mm from an interior surface of the front wall 308 of printer 300. The mounting orientation of printhead frame 250 is rotated relative to the view in FIG. 2 so that the printhead die 251 are located at the bottom side of printhead frame 250, the droplets of ink being ejected downward onto the paper or other recording medium (not shown) in print region 303. Paper advance motor 386 is shown but the various rollers that move the paper along media advance direction 304 are not shown in FIG. 17. Maintenance station 330 is provided for wiping and capping the nozzle face.

Figure 18:
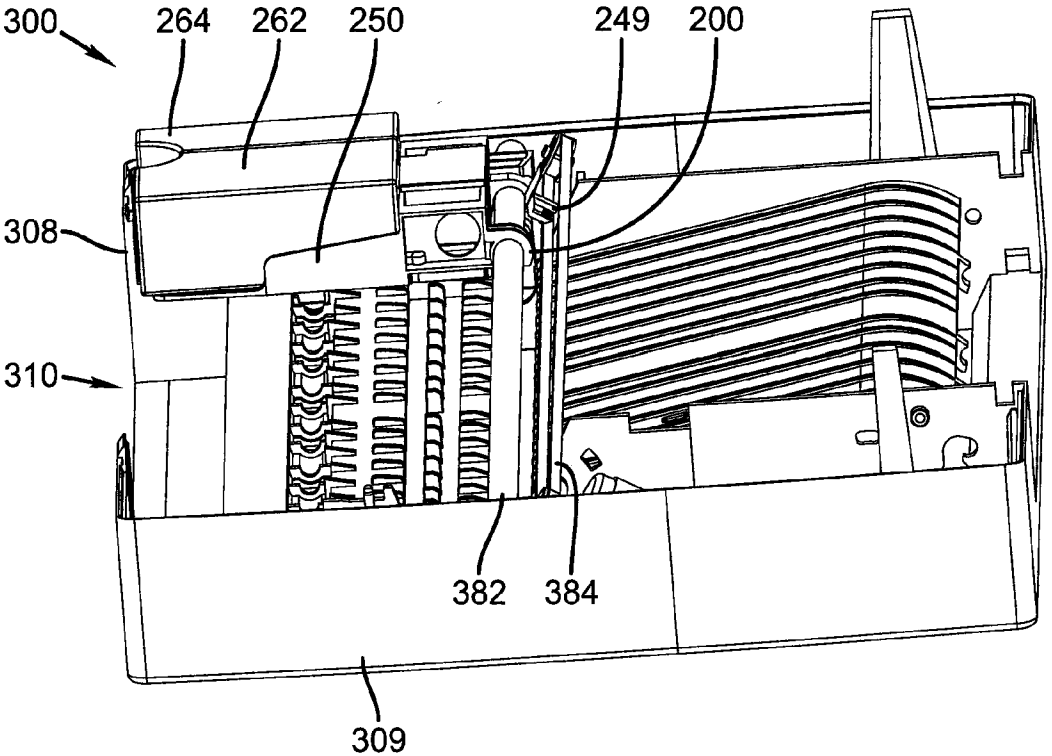
FIGS. 18 and 19 are perspective views of the carriage printer of FIG. 17.
Figure 19:
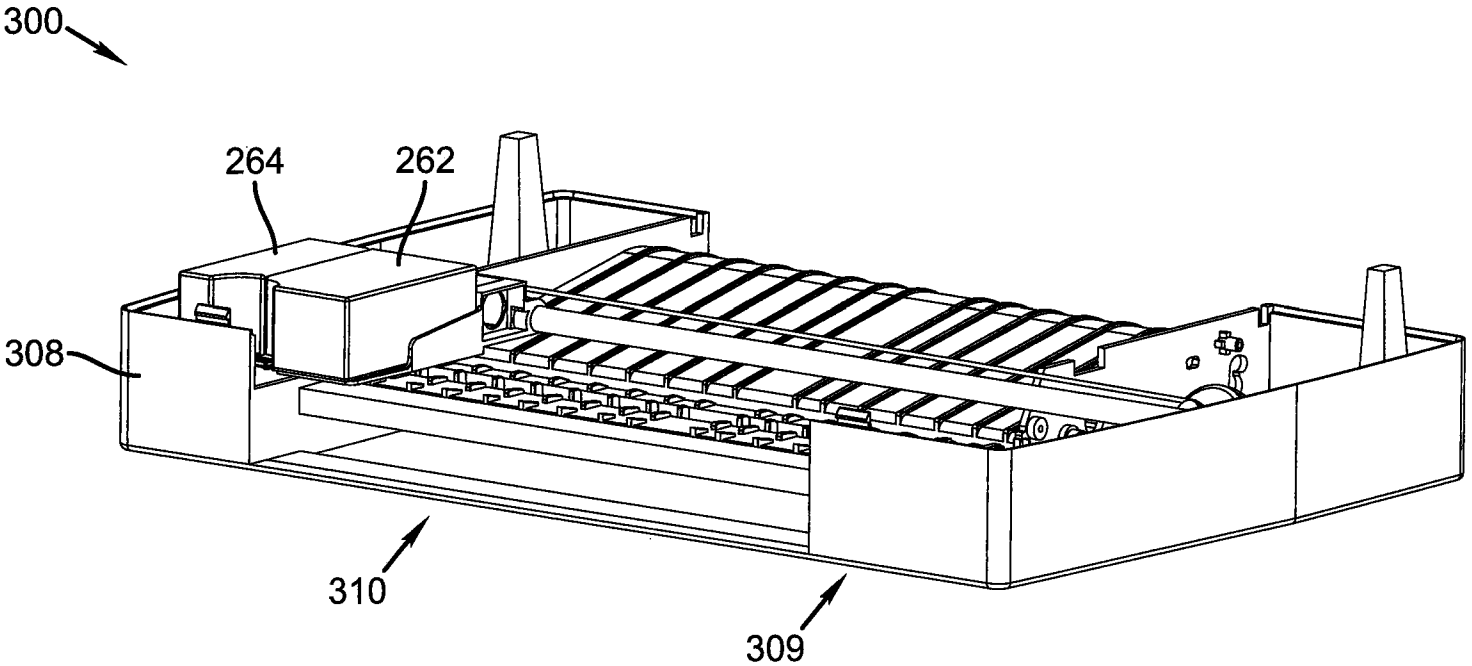

FIGS. 18 and 19 more clearly show front wall 308 of printer 300 and a doorway 310 through which the ink tanks 262 and 264 can be accessed for horizontal installation and removal. Printer 300 also includes a top surface (not shown), but the user can reach through doorway 310. Doorway 310 can consist of an opening as shown in FIGS. 18 and 19, or it can also optionally include a door (not shown) that the user can open in order to access the ink tanks 262 and 264. When an ink tank needs to be replaced, the carriage 200 is moved along carriage guide 382 until the ink tanks are located next to doorway 310. The user reaches through doorway 310 and releases the tank latch 218 or 219 corresponding to the ink tank 262 or 264 and grasps an end of the ink tank at the recessed connecting wall. The ink tank is then removed horizontally through the doorway 310. A replacement ink tank can then be inserted horizontally through doorway 310. The user can slide the replacement ink tank horizontally into the holding receptacle while holding down the tank latch 218 or 219. Finally, when the ink tank is fully inserted into the holding receptacle, the tank latch can be released so that it latches against wall 276 of the ink tank. FIG. 18 also shows belt attach member 249 of carriage 200 attached to belt 384 for moving the printhead frame 250 along carriage guide rail 382.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
202 Ink chamber
204 Ink chamber
206 Ink chamber
208 Ink chamber
210 Holding receptacle
211 First part (of holding receptacle)
212 Second part (of holding receptacle)
214 Base surface
215 First end
216 Second end
218 Tank latch
219 Tank latch
220 Wall
222 Ink inlet port
224 Ink inlet port
226 Ink inlet port
228 Ink inlet port
230 Partition
232 First sidewall
234 Second sidewall
242 Pressing direction
247 Corner
248 Bearing surface
249 Belt attach member
250 Printhead frame
251 Printhead die
253 Nozzle array
254 Nozzle array direction
262 Multi-chamber ink tank
264 Single-chamber ink tank
272 End wall (of ink tank)
276 Wall (of ink tank)
300 Printer
303 Print region
304 Media advance direction
305 Carriage scan direction
308 Front wall (of printer)
309 Base (of printer)
310 Die mount substrate
311 Butting portion (of second end wall)
312 Die mount surface
313 First end wall (of die mount substrate)

314 Latchable projection
315 Second end wall (of die mount substrate)
316 Extension
317 First ink passageway
318 Second ink passageway
319 First slot opening
320 Ink receiving surface
321 Second slot opening
322 Alignment feature (groove)
324 Sealing member
325 Openings (in sealing member)
330 Maintenance station
336 Connection pads
337 Leads
339 Wire bonds
340 Latch
342 Face
343 Arm
344 Latching bar
345 Recess
346 Wiring member
347 First portion (of wiring member)
348 Second portion (of wiring member)
349 Third portion (of wiring member)
350 Bracket
352 Finger
354 Surface (of finger)
360 Ink delivery surface
361 First end (of ink delivery surface)
362 Alignment feature (rib)
363 Second end (of ink delivery surface)
364 Ink delivery opening
380 Carriage motor
382 Carriage guide rail
384 Belt
386 Paper advance motor

The invention claimed is:

1. A method of assembling an inkjet printhead, the method comprising the steps of:

providing a die mount substrate including a die mount surface, an ink receiving surface, a first end wall having a latchable projection and a second end wall having an extension;

providing a printhead die including at least one nozzle array and a plurality of bond pads;

attaching the printhead die to the die mount surface of the die mount substrate;

providing a wiring member;

adhering a portion of the wiring member to the die mount surface of the die mount substrate;

electrically interconnecting the wiring member to the bond pads of the printhead die;

providing a printhead frame including an ink delivery surface, a latch and a bracket;

inserting the extension from the second end wall of the die mount substrate into the bracket;

providing a sealing member between the ink receiving surface and the ink delivery surface; and closing the latch to engage the latchable projection of the die mount substrate.

2. The method according to claim 1 further comprising bringing the ink receiving surface of the die mount substrate into a confronting position relative to the ink delivery surface of the printhead chassis before the step of closing the latch, wherein the sealing member is disposed between the ink receiving surface and the ink delivery surface.

3. The method according to claim 2, wherein the step of bringing the ink receiving surface of the die mount substrate into a confronting position relative to the ink delivery surface of the printhead frame further comprises pivoting the die mount substrate about the extension within the bracket.

4. The method according to claim 2, wherein the step of bringing the ink receiving surface of the die mount substrate into a confronting position relative to the ink delivery surface of the printhead frame further comprises displacing the latch to an open position.

5. The method according to claim 4, wherein the step of closing the latch further comprises allowing the latch to snap into a normally closed position.

6. The method according to claim 2, wherein the step of bringing the ink receiving surface of the die mount substrate into a confronting position relative to the ink delivery surface of the printhead frame further comprises mating an alignment feature on the ink receiving surface with a corresponding alignment feature on the ink delivery surface.

7. The method according to claim 1, the printhead die including an ink feed slot and the die mount surface including a first slot opening, wherein the step of attaching the printhead die to the die mount surface further comprises:

applying an adhesive to the die mount surface around the first slot opening;

aligning the printhead die such that the ink feed slot confronts the first slot opening of the die mount surface with the adhesive contacting the printhead die; and curing the adhesive.

8. The method according to claim 1, wherein the step of providing the die mount substrate further comprises injection molding the die mount substrate.

9. The method according to claim 1, wherein the step of providing the printhead frame further comprises injection molding the printhead frame.

10. The method according to claim 1, further comprising the step of encapsulating the electrical interconnections between the wiring member and the bond pads of the printhead die.

11. The method according to claim 1, the printhead frame further comprising a face proximate the latch, the method further comprising the steps of:

wrapping a portion of the wiring member around a portion of the latch after the latch is closed; and attaching a portion of the wiring member to the face, thereby securing the latch.

12. The method according to claim 11, wherein the step of attaching a portion of the wiring member to the face further comprises adhering a portion of the wiring member to the face with an adhesive.

13. The method according to claim 1, wherein the step of providing a sealing member further comprises inserting an elastomeric gasket between the ink receiving surface and the ink delivery surface.

14. The method according to claim 1, wherein the step of providing a sealing member further comprises applying an adhesive between the ink receiving surface and the ink delivery surface.

* * * * *